United States Patent [19]

Alsch

[11] 4,360,719

[45] Nov. 23, 1982

[54] STEP SWITCH

[75] Inventor: Gottfried Alsch, Vienna, Austria

[73] Assignee: Hubert Laurenz Naimer, Ascona, Switzerland

[21] Appl. No.: 194,075

[22] Filed: Oct. 6, 1980

[30] Foreign Application Priority Data

Oct. 17, 1979 [AT] Austria ..... 6763/79

[51] Int. Cl.[3] ..... H01H 19/24

[52] U.S. Cl. ..... 200/65; 200/11 R; 220/154

[58] Field of Search ..... 200/11 R, 14, 17 R, 200/18, 153 V, 154, 63 R, 63 A, 65, 66

[56] References Cited

U.S. PATENT DOCUMENTS 1,684,257 9/1928 Boelter et al. ..... 200/65 X 3,283,596 11/1966 Roeser ..... 200/65 X 4,002,088 1/1977 Alsch ..... 74/777

*Primary Examiner*—A. T. Grinney

*Assistant Examiner*—Morris Ginsburg

*Attorney, Agent, or Firm*—Kurt Kelman

[57] ABSTRACT

A rotary switch comprising a rotatable driving shaft and a coaxial driven switching shaft has a coupling arranged between the shafts for indexing the rotary movement of the switching shaft in response to the rotation of the driving shaft. The coupling includes driving and driven coupling parts respectively keyed to the driving and driven shaft, the coupling parts having peripheries coaxial with the shafts. A spring having two ends respectively engaging the coupling parts is tensioned in the direction of the coupling part peripheries and a blocking device controlled by the rotary position of the shafts in relation to each other respectively blocks and unblocks the rotary movement of the driven coupling part.

6 Claims, 5 Drawing Figures

STEP SWITCH

Figure 1:
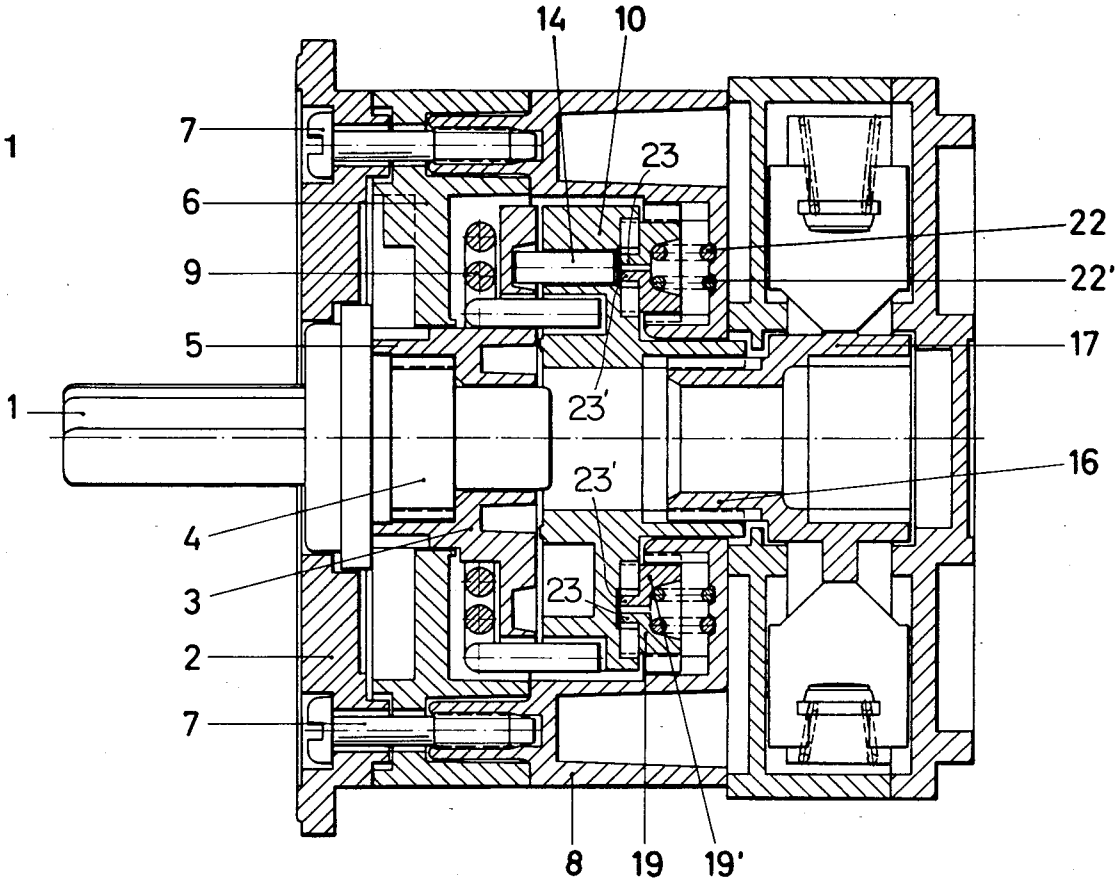

The present invention relates to a rotary switch and, more particularly, to a step switch which comprises a rotatable driving shaft and a coaxial driven switching shaft having more than two indexed positions controlled by the driving shaft for actuating the switch contact, with a blocking device for determining the indexed positions.

U.S. Pat. No. 4,002,088 discloses a switch of this type. In this switch, a compensation gear connects the driving shaft to the switching shaft, the housing of the gear being fixedly positioned during the normal operation and being released only to enable unblocking. During normal operation, the driven switching shaft rotates with the driving shaft in accordance with the reduction ratio of the compensation gear.

In the manually operated switches, the speed with which the movable contacts are removed from the fixed contacts is directly proportional to the rotary speed of the driving shaft. Therefore, if the driving shaft is rotated slowly, the slow separation of the contacts may result in the formation of very strong electric sparks, reducing the operating life of the contacts considerably and even causing the destruction of the switch by damaging the insulating supports of the contacts or burning out the contacts.

For this reason, switches have been proposed in which the speed of the contact movement is predetermined and is practically unrelated to the operation of the switch, as is the case in motor-driven switches. However, such switches are expensive and, furthermore, they depend on a source of energy which is not always available.

Manually operated switches in which the speed of the contact movement is independent of the speed of the switch actuation are also known. These switches, however, have only two switching positions and operate on the bell crank lever principle.

It is the primary object of this invention to provide a step switch with a multiplicity of indexed switching positions and in which the speed of the contact movement on actuation of the switch is independent of the actuating speed and the corresponding rotary speed of the driving shaft.

The above and other objects are accomplished according to the invention with a coupling arranged between the shafts for indexing the rotary movement of the switching shaft in response to the rotation of the driving shaft, which coupling includes a driving coupling part keyed to the driving shaft, a driven coupling part keyed to the switching shaft, the coupling parts having peripheries coaxial with the shafts, a spring having two ends respectively engaging the coupling parts and being tensioned in the direction of the coupling part peripheries, and a blocking device controlled by the rotary position of the shafts in relation to each other for respectively blocking and unblocking the rotary movement of the driven coupling part.

This arrangement makes it possible to unblock the driven coupling part only after the shafts have reached a predetermined relative angular position so that the tensioned connecting spring biases the driven coupling part with a pulling force sufficient to produce the desired speed of the contact movement, the control of the blocking device by the rotary movement of the driving shaft assuring at the same time that the driven coupling part is arrested and blocked in the first indexed position determined by the blocking device in the direction of rotation. This is obtained by the diminuition of the angle of the relative rotary movement of the driving and driven shafts. This also assures that the switching shaft is successively retained in respective indexed positions and is released therefrom in succession as the driving shaft is rotated about an angle covering a succession of such positions, thus producing a stepped switching movement.

Figure 2:
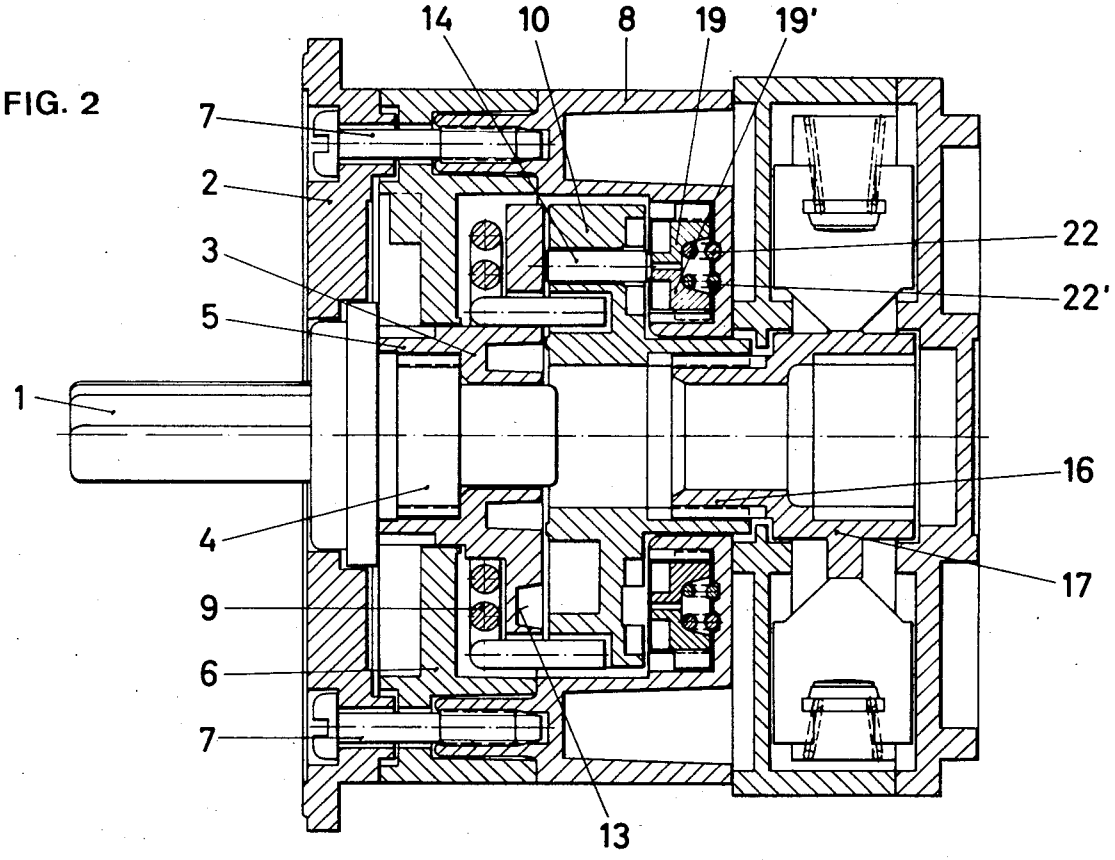
Figures 3A, 3B, 3C:
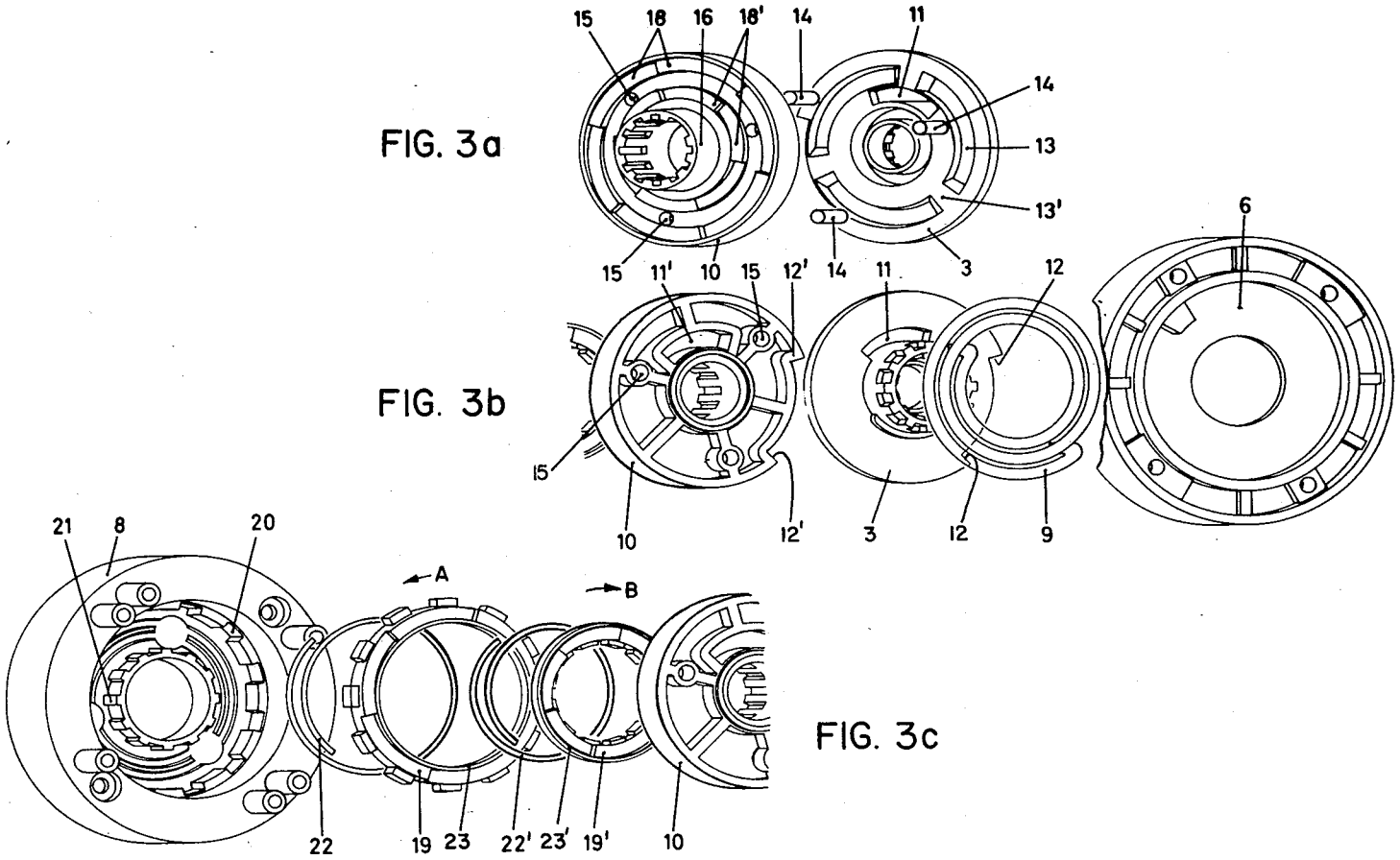

The above and other objects, advantages and features of the present invention will become more apparent from the following detailed description of a now preferred embodiment thereof, taken in conjunction with the accompanying drawing wherein:

FIG. 1 shows an axial section of a rotary switch incorporating the coupling of this invention, in the rest position;

FIG. 2 is a like view illustrating the switch in the position in which the switching shaft is unblocked; and FIGS. 3*a*, 3*b* and 3*c* are exploded perspective views of the coupling, FIG. 3*a* showing the coupling parts viewed from the rear, FIG. 3*b* showing the coupling parts, the connecting spring and a front mounting part viewed from the front, and FIG. 3*c* showing the driven coupling part, blocking means and a rear mounting part viewed from the front.

Referring now to the drawing, the switch is shown to comprise rotatable driving shaft 1 journaled in a central bore in cover plate 2. A suitable handle may be keyed to the driving shaft for rotation thereof and corresponding actuation of the switch. Driven switching shaft 17 is coaxial with driving shaft 1 and the shafts are coupled together for indexing the rotary movement of the switching shaft in response to the rotation of the driving shaft.

The coupling for the shafts includes driving coupling part 3 keyed to driving shaft 1 and driven coupling part 10 keyed to switching shaft 17, the coupling parts being illustrated as discs having peripheries coaxial with the shafts and respective surfaces facing each other. The coupling parts are encased in a housing comprised of a cup-shaped front part 6 and cup-shaped rear part 8, the front and rear parts of the housing being screwed together by screws 7 which connect the housing parts to cover plate 2 to form the switch housing. Front housing part 6 has a central bore coaxial with the shafts and hub 5 of driving coupling part 3 extends through the central bore and is internally ribbed for engagement with sprocket 4 on driving shaft 1. In this manner, coupling part 3 is driven by and with driving shaft 1.

Coil spring 9 (best shown in FIG. 3*b*) has two ends respectively engaging coupling parts 3 and 10 and is held under tension between the coupling parts, the spring being positioned in a free space defined between the facing surfaces of driving coupling part 3 and front housing part 6. As shown in FIG. 3*b*, each coupling part defines a first arcuate recess 11, 11' and a second arcuate recess respectively defined between shoulders 12, 12', the first recesses being illustrated as arcuate slots in the coupling parts and the second recesses being peripheral cutouts therein. In the rest position, the first and second recesses of coupling parts 3 and 10 are in registry with each other and the recesses extend between two substantially radially extending walls. The coil spring is coaxial with the coupling parts and the ends of the coil spring project axially into the first and second recesses of the coupling parts respectively for engagement with the recesses. The coil spring is tensioned and one coil spring end engages the trailing walls of the first recesses in a clockwise direction and the other coil spring end engages the leading walls of the second recesses in a clockwise direction (see FIG. 36). This arrangement enables the parts to be readily assembled and makes it very easy to mount the spring which transmits the rotary movement from the driving to the driven shaft. Furthermore, the tension built into the coil spring at the time of assembly produces a predetermined angular relationship in the rotary position of the shafts so that the positioning of the switch handle deterines the switching position.

The coupling further includes a blocking device controlled by the rotary or angular position of the shafts in relation to each other for respectively blocking and unblocking the rotary movement of driven coupling part 10. Pins 14 axially movable in bores or bearing sleeves 15 in the driven coupling part control the blocking device. As shown in FIG. 3*a*, control cam means 13 is arranged on the surface of driving coupling part 3 facing the surface of driven coupling part 10 and is engaged by one end face of pins 14. The illustrated control cam means comprises annular control cam 13 having three circumferentially spaced projections whose lateral walls enclose an angle of, for example, 45° with the cam surface, the three projections cooperating with the three control pins 14 upon rotation of the driving shaft in relation to the driven shaft.

As shown in FIGS. 1 and 2, driven coupling part 10 has an internally ribbed hub 16 passing through a central bore in rear housing part 8 and engaging a meshing sprocket on switching shaft 17 to enable the switching shaft to be rotated with the driven coupling part.

The other end faces of control pins 14 engage the blocking device. The illustrated blocking device comprises two concentrically arranged rings of bosses 18, 18' projecting axially from the surface of driven coupling part 10 facing away from driving coupling part 3, the bosses having inclined surfaces and the surfaces of bosses 18 in one ring rising gently in one direction of rotation while bosses 18' have surfaces rising gently in the opposite direction. The blocking device further includes non-rotatable but axially movable means spring-biased towards the driven coupling part, the blocking means having bosses cooperating with bosses 18, 18' on driven coupling part 10. This assures in a simple manner the release of the blocking device when the angle of relative rotation of the coupling parts is exceeded while assuring the re-engagement practically immediately after release by the spring bias moving the blocking means towards the driven coupling part. In this manner, the blocking device will operate again when the next indexed position has been reached and will arrest the driven coupling part even if rotation of the driving shaft is continued.

The illustrated blocking means comprises two concentrically arranged and non-rotatable ratchet wheels carrying bosses 19, 19' and spring means 22, 22' for axially biasing the ratchet wheels, bosses 19, 19' extending axially from the ratchet wheels and having inclined surfaces matching those of bosses 18, 18'. As clearly shown in FIG. 3*c*, the blocking means constituted by the ratchet wheels is non-rotatably mounted and axially guided in cup-shaped rear housing part 8, the housing part having internally ribbed portion 20 meshing with peripherally ribbed ratchet wheel 19 and peripherally ribbed portion 21 meshing with internally ribbed ratchet wheel 19'. The non-rotatably ratchet wheels are axially movable and are biased towards driven coupling part 10 by coil springs 22 and 22' seated in cup-shaped rear housing part 8 and pressing the ratchet wheels against the driven coupling part. In this way and as shown in FIG. 1, bosses 19, 19' of the ratchet wheels engage bosses 18, 18' on coupling part 10 in the rest position and block a relative rotational movement of coupling part 10 and switching shaft 17 keyed thereto as long as the bosses remain in engagement.

This arrangement of the bosses enables the indexed positions to be established very precisely and to be separated from each other by very small rotational angles. Because of the provision of two ratchet wheels with peripheral bosses inclined in opposite directions A and B (see arcuate arrows in FIG. 3*c*), the driving shaft may be turned in either direction to position the switching shaft accurately in a respective indexed position determined by the shoulders of the bosses extending substantially perpendicularly to the surfaces thereof. The control pins 14 control both ratchet wheels, the other ends of control pins 14 engaging annular rims 23, 23' projecting axially from bosses 19, 19'.

In the illustrated embodiment, control cam 13 has protuberances 13' having lateral walls rising at an angle of about 45°. This has the advantage of releasing the ratchet wheel blocking means at an exactly predetermined angle of the relative rotation of the two coupling parts. It has the further advantage that the largest possible extent of engagement between the bosses on the ratchet wheels and the bosses on the driven coupling part is maintained during the largest part of the relative rotation of the coupling parts while it is then rapidly reduced, which prevents excessive contact of the bosses at their shoulders.

As shown in FIG. 1, the one end faces of control pins 14 engage the axially recessed portions of control cam 13 in the rest position of the switch so that bosses 19, 19' on the ratchet wheels are in full engagement with bosses 18, 18' on driven coupling part 10. This holds switching shaft 17 in position against rotation. Rotation of driving shaft 1 correspondingly rotates coupling part 3 keyed thereto and causes coil spring 9 to be tensioned regardless of the direction of rotation of the driving shaft because one end of the spring is engaged by the trailing walls of the first recesses and the other spring end is engaged by the leading walls of the second recesses. In this manner, one spring end is always retained in its position by driven coupling part 10 while the other spring end is always taken along by driving coupling part 3. The rotation of driving coupling part 3 causes control pins 14 to be axially moved in the direction of the ratchet wheels carrying bosses 19, 19' as the pins engage the rising surfaces of cam 13, the end faces of the control pins respectively engaging the surfaces of control cam 13 on coupling part 3 and annular rims 23, 23' of the ratchet wheels which are biased by coil springs 22, 22' towards driven coupling part 10. Finally, the two coupling parts are rotated in relation to each other when control pins 14 have displaced the ratchet wheels so far against the bias of springs 22, 22' that bosses 18, 18' are disengaged from bosses 19, 19' and thereby release the latter bosses. This enables tensioned coil spring 9 to pull driven coupling part 10. Simultaneously with the beginning of the rotation of driven coupling part 10, control pins 14 start to be axially displaced by the force of springs 22, 22' acting on the ratchet wheels. This is caused by the descending surfaces of control cam 13 gliding under control pins 14 during the relative rotation of coupling parts 3 and 10 while springs 22, 22' bias the ratchet wheels and, thus, control pins 14 in the direction of driving coupling part 3. Therefore, as the driven coupling part is rotated by the tensile force of coil spring 9, the gently rising surfaces of bosses 19, 19' on the ratchet wheels glide along the gently rising surfaces of bosses 18, 18' until the step of perpendicular lateral walls of the bosses come into engagement with each other, which blocks driven coupling part 10 from further rotation since the ratchet wheels are non-rotatably mounted in rear housing part 8.

What is claimed is:

1. A rotary switch having a housing containing:

(a) a rotatable driving shaft;

(b) a coaxial driven switching shaft;

(c) a driving coupling part keyed to the driving shaft;

(d) a driven coupling part keyed to the switching shaft;

(e) a spring having two ends respectively engaging the coupling parts holding the coupling parts under tension and coupling the shafts keyed to the coupling parts together for indexing the rotary movement of the switching shaft in response to the rotation of the driving shaft; and (f) a blocking device, means whereby said blocking device is controlled by the rotary position of the shafts in relation to each other for respectively blocking and unblocking the rotary movement of the driven coupling part and the switching shaft keyed thereto, the blocking device including (1) a set of bosses projecting axially from the surface of the driven coupling part, (2) a ratchet wheel arranged non-rotatably and guided in the housing, the ratchet wheel having a set of bosses projecting axially towards the bosses on the driven coupling part for cooperating engagement therewith, the bosses having inclined surfaces and the inclined surfaces of the bosses of one set rising gently in a direction opposite to that of the inclined surfaces of the bosses of the other set; and (3) spring means for axially biasing the ratchet wheel.

2. The rotary switch of claim 1, wherein each coupling part defines a first arcuate recess and a second arcuate recess, the first recesses and the second recesses of the coupling parts being in registry with each other and the recesses extending between two substantially radially extending walls, the spring is a coil spring coaxial with the coupling parts and the ends of the coil spring project axially into the first and second recesses of the coupling parts respectively for engagement with the recesses, one of the coil spring ends engaging the trailing walls of the first recesses in a clockwise direction and the other coil spring end engaging the leading walls of the second recesses in a clockwise direction.

3. The rotary switch of claim 1, further comprising control pins arranged for moving the bosses on the ratchet wheel axially out of engagement with the bosses on the driven coupling part to unblock the rotary movement of the driven coupling part and the switching shaft keyed thereto, the control pins being axially movable in bores in the driven coupling part and having two end faces respectively adjacent the facing surfaces of the coupling parts, and control cam means on the surface of the driving coupling part, one of the end faces of the control pins engaging the control cam means and the other end faces of the control pins engaging the ratchet wheel.

4. The rotary switch of claim 3, wherein the control cam means have protuberances rising at an angle of about 45°.

5. The rotary switch of claim 1, wherein the spring is a coil spring held between facing surfaces of the coupling parts.

6. The rotary switch of claim 1, comprising two concentrically arranged sets of bosses on the driven coupling part, two concentric ratchet wheels and two concentrically arranged sets of bosses on the ratchet wheels.

* * * * *